US005408088A

United States Patent [19]

Chapman et al.

[11] Patent Number: 5,408,088

[45] Date of Patent: Apr. 18, 1995

[54] ELECTROSTATICALLY-FOCUSED IMAGE INTENSIFIER TUBE AND METHOD OF MAKING

[75] Inventors: William A. Chapman, Phoenix; Charles A. Rowell, Tempe, both of Ariz.

[73] Assignee: Litton Systems, Inc., Woodland Hills, Calif.

[21] Appl. No.: 168,022

[22] Filed: Dec. 15, 1993

[51] Int. Cl.[6] ..... H01J 31/50

[52] U.S. Cl. ..... 250/214 VT; 313/524

[58] Field of Search ..... 250/214 VT; 313/103 CM, 313/105 A, 527, 528, 542, 524; 315/11

[56] References Cited

U.S. PATENT DOCUMENTS 3,114,044 12/1963 Sternglass ..... 250/214 VT 3,487,258 12/1969 Manley et al. ..... 315/11

4,315,184 2/1982 Santilli et al. ..... 313/524

5,304,815 4/1994 Suzuki et al. ..... 250/214 VT

*Primary Examiner*—David C. Nelms

*Assistant Examiner*—Stephone B. Allen

*Attorney, Agent, or Firm*—Poms, Smith, Lande & Rose

[57] ABSTRACT

An improved electrostatically-focused image intensifier tube, and a night vision device having such a tube, is substantially free of the spurious bright spots generally known as "PC Flash". The improved image intensifier tube includes an insulator which resists emission of electrons into the interior cavity of the tube, or a structure to capture such emitted electrons before they can fall into a microchannel plate of the tube and cause the PC Flash. A method of making such an image intensifier tube is also disclosed.

28 Claims, 4 Drawing Sheets

FIG. 1.
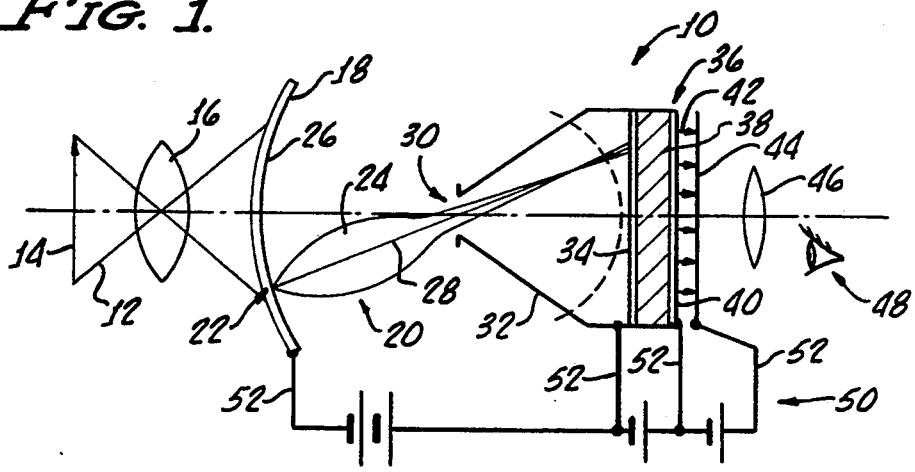
FIG. 4.
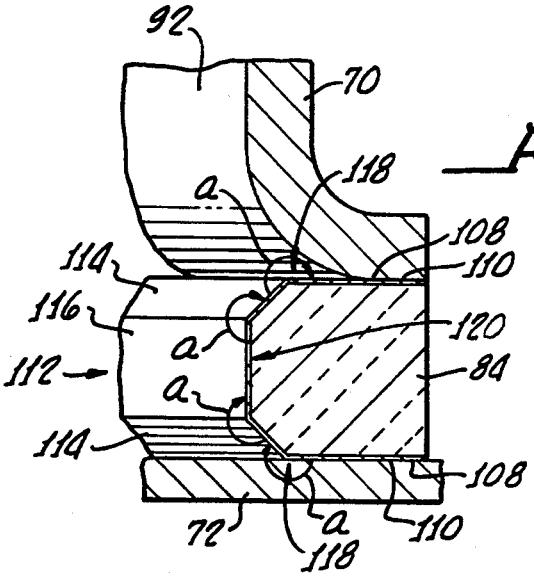
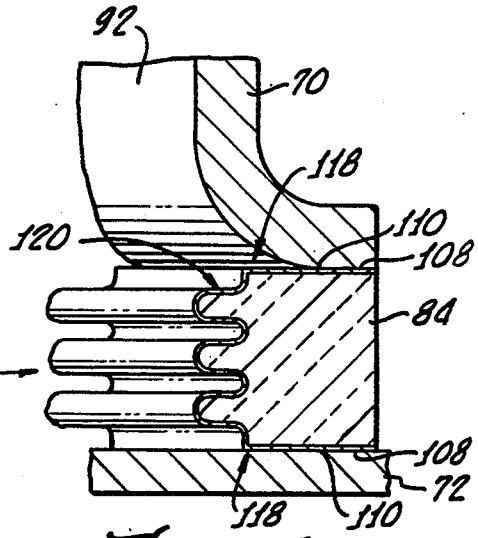
FIG. 5.
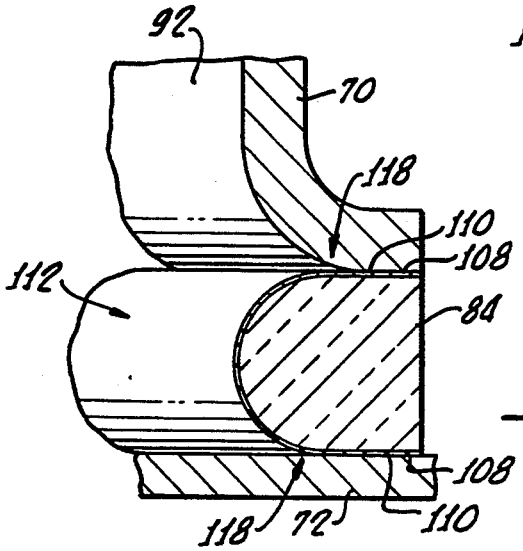
FIG. 6.

ELECTROSTATICALLY-FOCUSED IMAGE INTENSIFIER TUBE AND METHOD OF MAKING

BACKGROUND OF THE INVENTION

FIELD OF THE INVENTION

The present invention is in the field of image intensifier tubes of the type used for night vision devices. More particularly, the present invention relates to an image intensifier tube of the type which employs electrostatic electron-optics to invert and focus an image created by the tube. Still more particularly, the present invention relates to such an electrostatically-focused image intensifier tube having means for virtually eliminating the long-standing problem of "PC Flash". In the use of such a night vision device with an image intensifier tube, the user sees an intensified image of a scene which is illuminated only by low-level light, and which is too dim to be viewed with the natural vision (such as a night-time scene, or a scene inside of a darkened structure with only a little natural or artificial illumination). However, the user may also see bright spots at the periphery of the image which may come and go rapidly or which may persist for some considerable time. This problem is known generally as "PC Flash", or photocathode flash, and results in the user seeing bright spots, which do not originate with the scene being viewed, but which originate within the image intensifier tube itself. The bright spots obscure a portion of the image which should be provided by the night vision device, and interfere with the correct interpretation of the image presented. Also, the bright spots may suggest to the user of the night vision device that objects are present which in fact do not exist. The present invention provides an electrostatically-focused image intensifier tube, and method of making such a tube, which is virtually without the problem of PC flash.

RELATED TECHNOLOGY

A conventional electrostatically-focused image intensifier tube is known in accord with U.S. Pat. No. 3,487,258, issued on 30 Dec. 1969, to B. W. Manley, et al. The '258 patent is believed to teach a conventional image intensifier tube, which has become known as the Gen II type of tube. This image intensifier tube is used in conjunction with an optical lens system which focuses low-level light photons from a dimly illuminated scene onto a photocathode of the intensifier tube. In response to these photons, the photocathode releases photoelectrons in a pattern which replicates the image of the scene. The electrons released by the photocathode are electron-optically converged and focused by an electrostatic field within the image intensifier tube to a focal point (area) at the entrance opening of a focusing cone. Within the focusing cone, the electrons diverge from the focal point (area) to fall upon a microchannel plate. This microchannel plate includes a great multitude of very small (or micro) channels extending through the plate, and is configured and electrostatically charged to proportionately emit secondary electrons because of the impacts of photoelectrons on the inner walls of the microchannels. Consequently, the photoelectrons and a shower of secondary-emission electrons exit the channels of the microchannel plate in a pattern which replicates the image falling on the photocathode. This electron shower is directed immediately onto a phosphorescent screen to produce an intensified image several orders of magnitude brighter than the low-level light from the imaged scene.

In the physical implementation of such an image intensifier tube, a plurality of metallic tubular members are stacked end to end with interposed ceramic insulator rings and are bonded hermetically together to form a tubular body for the intensifier tube. At one end, the tube is closed by a transparent face plate of glass or quartz, for example, which on its inner surface may carry the photocathode. At the opposite end, the tube body is closed by a transparent plate which on its inner surface may carry the phosphorescent material for forming the output image from the tube. The interior of this tube body is evacuated to a high vacuum, and the individual metallic tubular sections of the body are connected to respective voltage leads of a high-voltage image tube power supply circuit. The individual stacked-up metallic tubular body sections are especially configured, and are connected to particular voltage levels, in order to form and control the electrostatic fields necessary for the operation of the image intensifier tube. Additional objective and eyepiece optics, as well as a housing for the components of the system, will ordinarily be used in conjunction with such an image intensifier tube to complete a night vision device.

As pointed out above, this type of image intensifier tube has long been subject to an undesirable operational characteristic, known as "PC Flash". Apparently, this characteristic was first thought to originate with the photocathode of the image intensifier tube. This mistake is not hard to understand since the photocathode is the element in the image intensifier tube which is supposed to liberate electrons. These electrons are then amplified and produce an image on the phosphorescent screen. No other element or feature within the image intensifier tube is supposed to liberate electrons which could be amplified by the microchannel plate and form an image or bright spot on the output screen. Accordingly, the conventional thinking has been that the flashes seen on the output screens of conventional electrostatically-focused image intensifier tubes must originate somehow at the photocathodes of these tubes.

However, as is additionally explained herein, the Applicants have established that the PC Flash actually originates not with the photocathode of such an image intensifier tube, but in the vicinity of one of the metallic tubular sections of the tube body. The particular metallic tubular section in the vicinity of which these electrons are now known to originate is ordinarily referred to as a "field corrector", and defines one of the electrodes for the electrostatic fields of the image tube. Accordingly, the flash or bright spot phenomenon might more properly be referred to as, "corrector flash". However, for the sake of uniformity, the long-established term "PC Flash" will be used hereinafter.

Conventional wisdom would suggest that the metallic tubular section itself, perhaps because of some contamination in the tube, or because of roughness on the interior electrode surface of the body section, was liberating electrons into the high-vacuum interior of the tube. These electrons might originate perhaps because of some high-vacuum field-emission effect, or perhaps from a combination of such effects, created by the high vacuum and high applied voltages. However, regardless of what theory or hunch conventional thinking might have suggested, no solution to the PC Flash problem has been provided after many years during which many workers in the field have tried to solve this problem.

Further, a careful investigation by the Applicants of the possibility that the field-corrector electrode itself was emitting the electrons responsible for PC Flash showed no improvement in the problem. This investigation, included attempts to eliminate the problem by coating the field-corrector electrode, polishing its interior surfaces, and re-configuring the field-corrector electrode tubular body section component, all to avail. Also, a search of the available technology concerning high voltage field emissions and insulators revealed nothing which would teach or suggest a solution to the PC Flash problem of electrostatic image intensifier tubes. See, for example, "High Voltage Vacuum Insulation: The Physical Basis", by R. V. Latham, published in 1981 by Harcort, Brace, Jovanovich. This problem of PC Flash had persisted for many years in the field of electrostatically focused image intensifier tubes, and was not easily solved.

Additionally, because of the problem of PC Flash, the manufacturing yield of good image intensifier tubes has been substantially reduced throughout the industry. Finished image intensifier tubes all manufactured to the same specifications, and into which all manufacturing costs and materials have been sunk, unexplainably some times do and some times do not suffer from PC Flash. A percentage of the image tubes are substantially free of PC Flash. Some percentage of the image tubes suffer from the PC Flash only for an initial period after being turned on, and then clear up. The tubes which clear up after a period of operation can be used if this period is acceptably short. Other tubes always have a PC Flash bright spot. These latter tubes are not usable in night vision systems. However, disassembly of the unusable image tubes, which destroys the tubes, does not reveal why they produce a PC Flash. More ironically, disassembly of a perfectly-functioning image tube which is free of PC Flash does not reveal it to be any different than the unusable tubes. Accordingly, an understood or identifiable manufacturing variability does not appear to be responsible for the PC Flash phenomenon.

The yield of good image intensifier tubes from the conventional manufacturing process is also not well controlled. PC Flash historically caused a significant loss of yield from the manufacturing process.

SUMMARY OF THE INVENTION

In view of the above, a long-felt need has existed in the field of electrostatically-focused image intensifier tubes to reduce or eliminate the problem of PC Flash.

Further, a long-felt need has existed to improve the manufacturing process for electrostatically-focused image intensifier tubes to reduce or eliminate the problem of PC Flash, and to improve the yield of good intensifier tubes from the process.

The Applicants have determined that the electron emissions in an electrostatically-focused image intensifier tube, which electrons result in the PC Flash (or more properly, in the field-corrector flash), do not in fact originate from a surface of the field-corrector electrode, but instead originate from the vicinity of the inner surface of the insulator ring which is itself next adjacent to the field-corrector electrode, and is interposed between this field-corrector electrode and a next-adjacent field-former electrode, or from an interface (a so-called triple junction of metal, insulator, and high vacuum) of this insulator ring with the field-corrector electrode. According to another view of the high voltage physics involved, these electrons originate from such a "triple junction", which is formed at the interface of the metallic field-corrector electrode with the ceramic insulator and the high vacuum interior space of the image intensifier tube. According to one theory of high-vacuum, high-voltage insulation physics, the electrons can originate from charge skipping or hopping across the inner surface of the insulator ring from the triple junction toward the field former electrode. Apparently, some of these hopping electrons are kicked off into the high-vacuum interior cavity of the image intensifier tube, fall on the microchannel plate to be multiplied by this microchannel plate, and to cause PC Flash.

Accordingly, the present invention provides an electrostatically-focused image intensifier tube which includes an insulator ring interposed between the field-corrector electrode and the adjacent electrode, and having inner edge surface section means for preventing the emission of electrons from the insulator into the high vacuum interior of the image intensifier tube.

This preferred embodiment of the present invention may include edge surface means in the form of a chamfer surface intersecting with the field-corrector electrode and causing the insulator ring to define both an extended surface dimension between the field-corrector electrode and the adjacent electrode, to prevent line-of-sight relation between the interfaces of the ceramic insulator ring with the field-corrector electrode and the adjacent electrode, and to define exterior surface angles on the insulator ring which are less than 270 degrees.

Other alternative embodiments of the edge surface means of the insulator ring include serpentine, radiused, ribbed, and flanged configurations.

An alternative embodiment of the present invention provides an electrostatically-focused image intensifier tube having a tubular field-corrector electrode separated from an adjacent electrode by an insulator ring, and means for preventing electrons emitted from the vicinity of the insulator ring, and the interface of this insulator ring with the field-corrector electrode, from falling on a microchannel plate of the image intensifier tube.

According to one embodiment of the present invention, the preventing means includes a tubular fence or dam member electrically connected to the adjacent electrode, and interposed between the field-corrector electrode and the microchannel plate in the path of electrons which could cause a PC Flash bright spot on the output screen of the image intensifier tube.

An advantage of the present invention is that image intensifier tubes made according to the invention is virtually free of PC Flash.

A further advantage of the present invention is that users of night vision devices with the improved image intensifier tubes do not have their night-time vision adversely affected by a PC Flash.

Another advantage of the present invention is that the yield of good image intensifier tubes made according to the invention is in the range of from about 97 percent to 100 percent. All of those image intensifier tubes made according to the invention which did suffer from PC Flash have, upon disassembly, been shown to have a manufacturing process defect, either at an interface of the ceramic insulator ring with one of the field-corrector electrode or adjacent electrode, or on the inner surface of the ceramic electrode itself. These defects are not attributable to a short coming of the present invention, and represent an identifiable manufacturing process variability. Accordingly, the present invention effectively has solved and eliminated a long-standing problem with electrostatically-focused image intensifier tubes.

These and additional objects and advantages of the present invention will be apparent from a reading of the following description of several alternative preferred embodiments of the present invention taken in conjunction with the appended drawing Figures, in which the same reference numeral refers to the same feature, or to features which are analogous in structure or function to one another.

DESCRIPTION OF THE DRAWING FIGURES

FIG. 1 is a schematic presentation of a night vision system including an electrostatically-focused image intensifier tube embodying the present invention;

Figure 2:
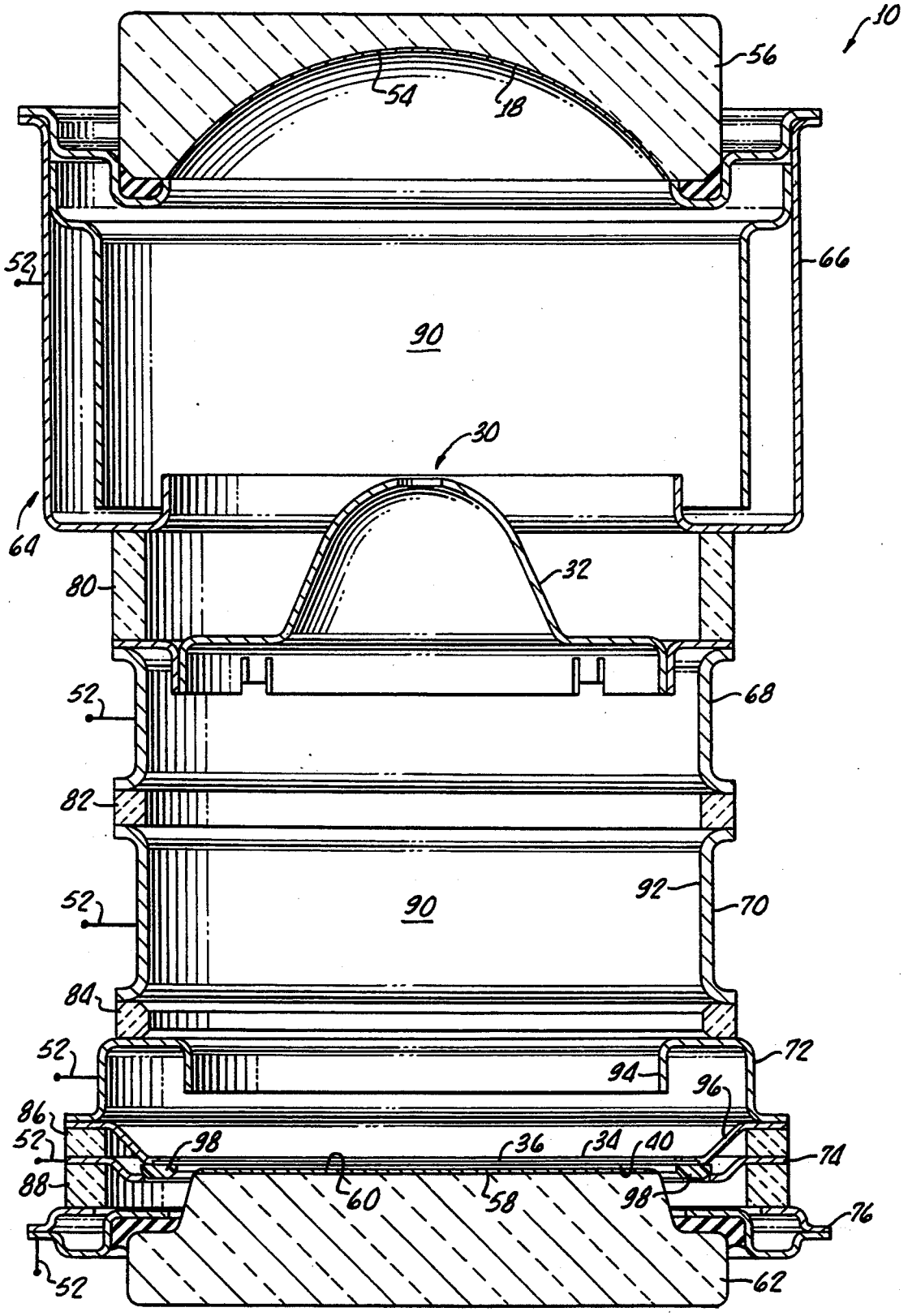
FIG. 2 is a longitudinal cross sectional view through an image intensifier tube according to the present invention.
Figure 7:
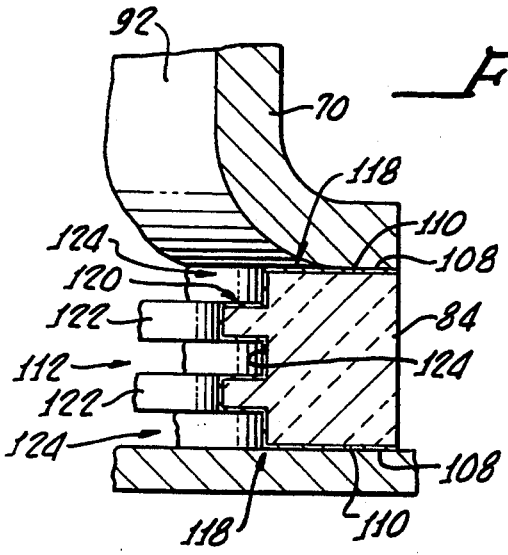
Figure 8:
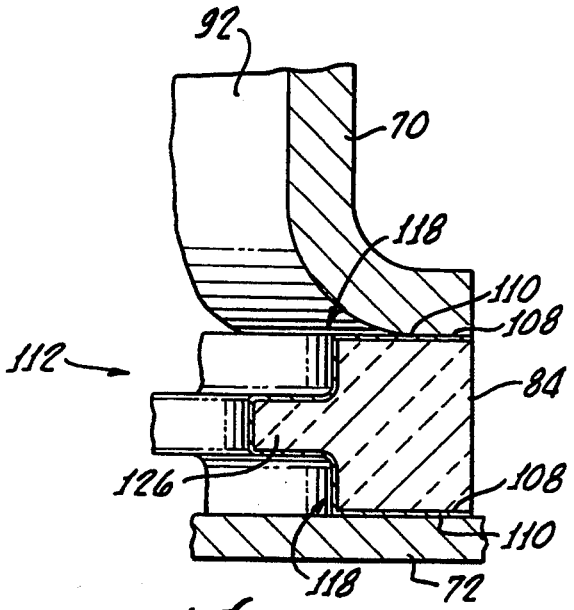
Figure 9:
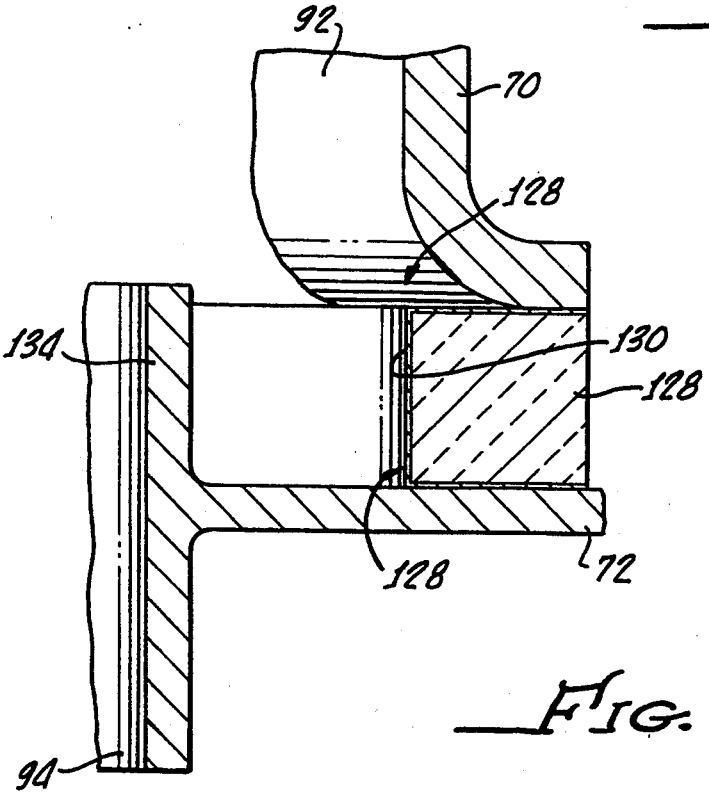

FIG. 4 provides a greatly enlarged fragmentary cross sectional view of the encircled portion of FIG. 2;

FIGS. 5–8 provide fragmentary enlarged cross sectional views similar to FIG. 4 of alternative embodiments of the present invention; and FIG. 9 shows a fragmentary enlarged cross sectional view similar to FIGS. 4–8, but depicting an additional alternative embodiment of the present invention.

DETAILED DESCRIPTION OF THE EXEMPLARY PREFERRED EMBODIMENTS OF THE INVENTION

FIG. 1 schematically depicts an electrostatically-focused image intensifier tube 10. This schematic depiction will seem familiar to those ordinarily skilled in the pertinent arts because it is very similar to a diagrammatic depiction used in the '258 patent issued in 1969. This schematic depiction of FIG. 1 illustrates the principles of operation of a night vision device having an electrostatically-focused image intensifier tube. The schematic depiction provides little information about the physical structure which will implement the image intensifier tube. However, the necessary physical description of the physical structure, and an explanation of the long-standing problem of PC Flash is additionally provided below.

Viewing FIG. 1 for a brief review of the operating principles of a night vision device with an electrostatically-focused image intensifier tube including a microchannel plate, light 12 from an object or scene 14 is imaged by an objective lens system, represented by a single lens 16 (but which may include one or more lenses) onto a photocathode 18. This photocathode 18 liberates photoelectrons 20 in response to the photons of light incident thereon. For example, photoelectrons from an exemplary spot 22 on the photocathode are liberated in a variety of directions (indicated by a shaded volume 24) from the inner face 26 of the photocathode. These photoelectrons 20 from the exemplary spot 22 are moved generally along a line indicated with the numeral 28 by applied electrostatic fields, which will be further explained. The line 28 passes through a focus area 30 for the image tube 10, which focus area 30 is defined by an opening in a focusing cone 32. The focusing cone 32 defines one of the electrostatic field-forming electrodes for the image intensifier tube 10. Also, as is shown by the shape of the volume 24 coincident with the focus area 30, the photoelectrons 20 are brought by the applied electrostatic fields into closer alignment with the line 28. All of the photoelectrons liberated from the inner face 26 of the photocathode 18 which will be multiplied to produce an image from the intensifier tube 10 pass along similar lines 28 through the focus area 30 and opening of the cone 32.

Within the focusing cone 32, the photoelectrons 20 diverge from the focus area 30 to fall across the perforate input surface or face 34 of a microchannel plate 36. These photoelectrons will have a pattern which replicates an inverted and reversed image of the physical object or scene 14 directed onto the photocathode 18. This micro channel plate 36 is configured with a multitude of very small channels (indicated with the numeral 38) extending between its electrically conductive and electrostatically charged faces, and is also configured and constituted so that it has a propensity to proportionately liberate secondary emission electrons in response to the impacts of photoelectrons 20 against the inner surfaces of the microchannels 38. Consequently, the photoelectrons 20, and a proportionate number of secondary emission electrons, exit the perforate output surface or face 40 of the microchannel plate as an electron shower 42 having a pattern replicating the image falling on the photocathode 18. This electron shower is directed immediately to a phosphorescent screen 44 to produce an image several hundred orders of magnitude more intense than the image on photocathode 18. A non-inverting eyepiece 46 may also be used to present the image produced by the intensifier tube 10 to a user 48. Because the objective lens system 16 inverted and reversed the image once, and the image intensifier tube inverts and reverses the image again, the intensified image presented to the user 48 is upright without the need to use an inverting eyepiece.

FIG. 1 also shows that the night vision device will include an image tube power supply, generally indicated with the numeral 50. This power supply 50 will have plural voltage output leads 52, connecting respectively to the photocathode 18, to the focusing cone 32, to the opposite faces (34, 40) of the microchannel plate 36, and to the phosphorescent screen 44. Additionally, the power supply 50 may have connection to additional field shaping, field correcting, or field forming electrodes (which will be further described) within the image intensifier tube 10.

Viewing now FIG. 2, a physical embodiment of the image intensifier tube 10 is shown in longitudinal cross section. As is seen viewing FIG. 2, the photocathode 18 is formed as a thin layer carried on the inner surface 54 of a transparent face plate 56. At the opposite end of the image intensification tube 10, the phosphorescent screen 44 is defined by a coating 58 of fluorescent or phosphorescent material which is carried on an inner surface 60 of a transparent output window 62. The face plate 56 and output window 62 are carried by and sealingly span and close respective opposite ends of a tubular image intensifier tube body, generally referenced with the numeral 64. This tubular body 64 is built up of plural metallic tubular sections 66, 68, 70, 72, 74, and 76.

The plural metallic tubular body sections 66–76, are stacked in end-to-end relation and are sealingly connected physically to one another by respective interposed ceramic insulator rings 80, 82, 84, 86, and 88. The ceramic insulator rings 80–88 generally have metallized axial faces, and are furnace brazed sealingly to the adjacent metallic tubular body sections. The face plate 56, output window 62, body sections 66–76, and insulator rings 80–88, cooperatively define a body cavity 90, which is evacuated to a high vacuum during manufacture of the image intensifier tube 10. Each one of the body sections 66–76 may be made up of plural individual component parts. For example, the body section 68 carries the focusing cone 32 defining the focus area 30 at a central opening thereof.

Those ordinarily skilled in the pertinent arts will recognize that the parts of each body section 66–76 are electrically continuous with one another so that some of the interior component parts or surfaces of particular body sections are configured in particular ways to shape the electrostatic fields to be formed within the body cavity 90. The body sections 66 and 76 carry respective face plate 56 and output window 62, with respective photocathode 18 and phosphorescent coating 58, each of which is electrically connected with the respective body section. However, the adjacent body sections are electrically isolated from one another, with the exception of electron flow within the tube cavity 90 from the photocathode 18, and from microchannel plate 36, both to the phosphorescent screen 44.

FIG. 2 also shows diagrammatically the electrical connections and the approximate applied voltages from the image tube power supply 50 to image intensifier tube 10. More particularly, the photocathode 18 is maintained at a potential of −1750 volts by a connection to body section 66. The next body section 68, has a connection which maintains the focus cone 32 at a potential of about +980 volts. The body section 70, the inner surface 92 of which defines a field-corrector electrode for the image tube 10, is maintained at the same potential (−1750 volts) as the body section 66 and photocathode 18 by a common connection of these components. Body section 72, which inwardly forms a field former portion 94 is maintained at a potential of from about −600 volts to about −1000 volts. This body section 72 also includes an internal annular flange portion 96 which in a central opening thereof carries the microchannel plate 36, and which effects an electrical connection with the input face 34 of this microchannel plate. Body section 74 is very short to take the form of an annular plate-like member having an electrical connection to a ground potential. This body section assists in carrying the microchannel plate 36, and effects an electrical connection with the output face 40 of this microchannel plate by means of a tapered snap ring member 98. The body section 76 is maintained at a potential of about +6000 volts.

Figure 3:
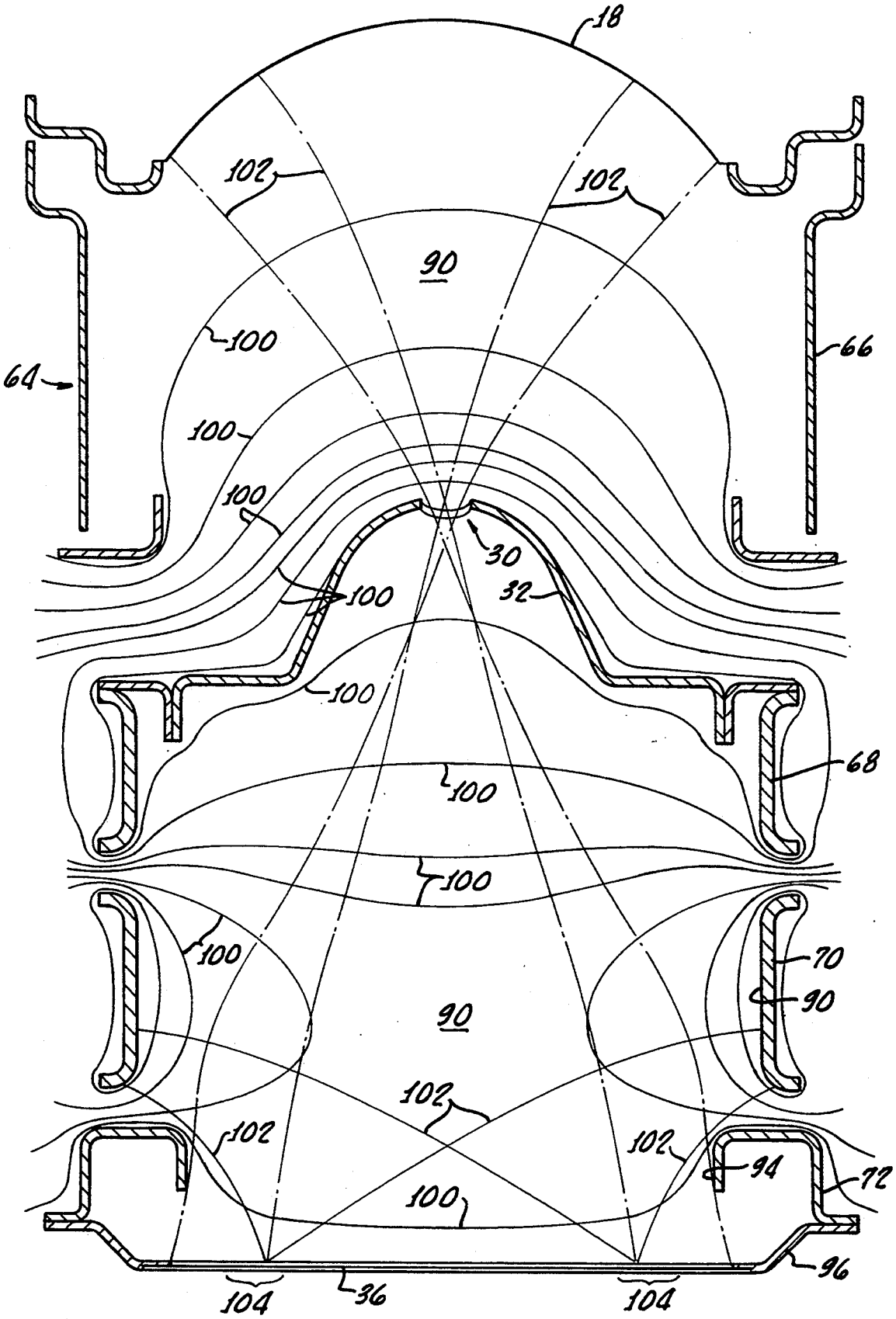
FIG. 3 is an electrostatic field map within an electrostatically-focused image intensifier tube, and shows an envelope of possible electron trajectories from the usual areas of PC Flash back to the expected origins of these electrons.

Viewing now FIG. 3, the body 64 with photocathode 18, and phosphorescent screen 44 are shown in outline. The individual body sections 66–76 are shown separated by gaps where the insulator rings 80–88 are located. Shown on FIG. 3 are electrostatic field equipotential trace lines 100, which give an indication of the shape of the electrostatic fields maintained within the cavity 90 during operation of the image intensifier tube 10. Also shown on FIG. 3 are exemplary electron trajectory lines 102 extending from the photocathode 18 to the phosphorescent screen 44. Of course the magnitude of any electron flow along any trajectory line 102 is greatly increased across the microchannel plate 36. However, the microchannel plate 36 does not significantly alter the trajectory of electrons, as is necessarily the case in order to preserve the electron-optical image pattern. Also shown on FIG. 3 are two area 104 which are part of the annular area of the phosphorescent screen where PC Flash would be expected with a conventional image intensifier tube. Extending from these areas 104 are reverse electron trajectory lines 106 which take into account the existing electrostatic fields in the tube 10. These electron trajectory lines 106 extend from the margins of the areas 104 of screen 44 where PC Flash would be seen in a conventional image intensifier tube back to the location where the electrons would have to originate in order to cause the PC Flash in the locations observed. The trajectory lines 106 are predicated upon an understanding that the PC Flash of conventional image intensifier tubes does not in fact originate with the photocathode. As is seen on FIG. 3, the electrons which cause the PC Flash phenomenon have to originate in the vicinity of the field-corrector electrode surface 92 on body section 70, from the insulator ring 84 (which conventional thinking generally would rule out as a source of emitted electrons), or at the interface of this insulator ring with the field-corrector electrode. As was pointed out above, an extensive investigative program to correct, coat, treat, reconfigure, or otherwise modify the inner surface field-corrector electrode 92 to eliminate the problem of PC Flash was unsuccessful.

However, FIG. 4 shows an enlarged fragmentary cross sectional view taken at the encircled portion of FIG. 2. This cross sectional view of FIG. 4 shows that according to the present invention, the insulator ring 84 includes opposite metallized coatings 108 on the axial faces 110 of this insulator ring. One of these metallized coatings is brazed to the adjacent body section 70, the inner surface of which forms field-corrector electrode 92, and the other metallized coating is brazed to the next adjacent electrode 72, which carries the field former electrode portion 94. In order to prevent the emission of electrons from the inner surface of this insulator ring 84, or from the interface of this insulator ring with the field-corrector electrode surface 92, the insulator ring 84 includes an inner edge surface section, generally referenced with the numeral 112. Preferably, this inner edge surface section takes the form of a pair of chamfer surfaces 114, which are separated by a central axially extending cylindrical surface portion 116.

Viewing FIG. 4, it is seen that the edge surface section 112 prevents line-of-sight communication between the inner extents 118 of the brazed interfaces between the insulator ring 84 and the adjacent tubular body sections 70, and 72. Also, the inner edge surface section 112 increases the surface distance across the insulator 84 in comparison to the surface dimension of the conventional insulator ring with a straight circular cylindrical bore, which a conventional image tube would have in this location. Also, the chamfer surfaces 114 cooperate with the cylindrical surface 116, and with the opposite axial faces 110 (carrying coatings 108) to define exterior angles "a" on the inner edge surface section 112 of the insulator ring 84. These exterior angles are all less than 270 degrees, which is the exterior angle defined by a square corner. More particularly, the angles "a" are each about 135 degrees, being produced by 45 degree chamfers. A layer of chrome oxide 120 is carried on the inner edge surface section 112 to further inhibit electron emissions from this surface. Further, it will be seen that the chamfer surfaces 114 recess the metallized coatings 108 radially outwardly with respect to the cavity 90. In other words, the radially inner extent of each of the metallized coatings 108 is radially outward of the inner extent of the inner edge surface section 112. This is considerably in contrast to the insulators of conventional electrostatically-focused image intensifier tubes, in which the metallized axial face coatings of the insulators extend to, or almost to, the radially inner extent of the insulator rings.

Actual image intensifier tubes embodying the present invention, and made with insulator rings 84 having an edge surface section as shown in FIG. 4, have shown no PC Flash. The only exceptions to this total elimination of PC Flash have been image tubes in which a small whisker of braze material forms at one of the interfaces 118, and defines a highly effective electron emitter. Other image intensifier tubes with PC Flash have had a section of the chrome oxide coating chipped or cracked so that the broken edges form effective electron emitters. However, with the exception of these two types of manufacturing defects, which result from variabilities of the manufacturing process and are not very frequent, none of the other image intensifier tubes made with the present invention had any PC Flash at all.

FIGS. 5–8 depict alternative embodiments of the resent invention. In order to obtain reference numerals for use in describing the structures of FIGS. 5–8, features which are the same or are analogous in structure or function to a feature described above, are referenced with the same numeral used above. Viewing FIG. 5, an insulator ring 84 is seen to define a serpentine inner edge surface section 112. This serpentine edge surface section also increases the surface distance between the interfaces 118, and shields these interfaces from one another so that line-of-sight relation between them does not exist.

FIG. 6 shows another alternative embodiment in which the insulator ring 84 is inwardly crowned or radiused at the inner edge surface section 112.

FIG. 7 depicts yet another alternative embodiment of the present invention in which the insulator ring 84 defines an inner edge surface section 112 which is ribbed or grooved. That is, the surface 112 includes plural circumferentially extending ribs 122 separated from one another by interposed grooves 124. These ribs and grooves are shown as being square-shouldered, although this need not be the case. Alternatively, the ribs and/or grooves of the insulator ring 84 could be configured to be other than square in transverse cross section. For example, the ribs and/or grooves of an insulator ring could be configured to be of V-shape in section.

Finally, FIG. 8 shows an insulator ring 84, which at inner edge surface section 112, defines a radially inwardly extending circumferential flange portion 126. This flange portion 126 is shown as extending purely radially inwardly, although such need not be the case. For example, the flange portion 126 could be configured to extend radially inwardly and also axially (i.e., to define a truncated conical surface both inwardly and outwardly).

FIG. 9 depicts a fragmentary enlarged cross sectional view like FIGS. 4–8, but depicting an alternative embodiment of the invention. Viewing Figure 9, it is seen that an image intensifier tube 10 includes a conventional ceramic insulator ring 128. This conventional insulator ring 128 defines a straight cylindrical bore 130, and the inner interfaces 132 of the ring 128 with the tubular body sections 70 and 72 have line-of-sight relation with one another. However, according to this alternative embodiment of the present invention the next adjacent electrode to the field-corrector electrode 70 (which is electrode 72, forming field-former 94), also defines an axially extending fence portion 134, which is radially congruent with and radially inwardly of the insulator ring 128. This fence portion 134 is at the same electrostatic potential as the remainder of tubular body section 72. In other words, in comparison to the body section 70, and field-corrector electrode surface 92, the fence is at a positive potential of from about 750 volts to about 1150 volts. Accordingly, any electrons which are emitted from the surface of the insulator 128, or from the interface of this insulator with either of the tubular body sections 70 or 72, will be captured by the fence portion 134 and will not fall upon the microchannel plate 36 to cause a PC Flash.

While the present invention has been depicted, described, and is defined by reference to particularly preferred embodiments of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiments of the invention are exemplary only, and are not exhaustive of the scope of the invention. Consequently, the invention is intended to be limited only by the spirit and scope of the appended claims, giving full cognizance to equivalents in all respects.

We claim:

1. A night vision device having an electrostatically-focused image intensifier tube which is substantially free of PC Flash, said image intensifier tube comprising:

a tubular electrode separated from an adjacent tubular electrode by an insulator ring; and one of:

means for substantially preventing emission of electrons from said insulator ring; and means for capturing electrons emitted from said insulator ring;

whereby, either substantially no electrons are emitted from the insulator ring to fall upon a microchannel plate of said image intensifier tube, or electrons emitted from the insulator ring are prevented by said capturing means from falling on said microchannel plate of the image intensifier tube.

2. The night vision device of claim 1 wherein said means for preventing includes said insulator ring having inner edge surface section means for substantially preventing the emission of electrons from the insulator ring into the interior of the image intensifier tube.

3. The night vision device of claim 2 wherein said inner edge surface section means includes an inner surface configuration on said insulator ring which is selected from the group including: a chamfer surface, a serpentine surface, a radiused surface, a crowned surface, a ribbed surface, a grooved surface, and a flanged surface.

4. The night vision device of claim 3 wherein said inner edge surface section means includes an inner surface configuration which also prevents line-of-sight relation of radially inner interfaces defined by said insulator ring with said electrode and said adjacent electrode.

5. The night vision device of claim 3 wherein said inner edge surface section means surface configuration is selected to be a chamfered configuration, and said chamfered configuration includes adjacent surface portions which cooperatively define an exterior angle of less than 270 degrees.

6. The night vision device of claim 1 wherein said means for capturing includes said adjacent electrode defining a fence portion disposed radially inwardly of and congruent with said insulator ring.

7. An electrostatically-focused image intensifier tube which is substantially free of PC Flash, said image intensifier tube comprising a tubular electrode separated from an adjacent tubular electrode by an insulator ring; and means for substantially preventing emission of electrons from said insulator ring.

8. The image intensifier tube of claim 7 wherein said means for preventing includes said insulator ring having an axial face upon which is carried a metallic coating for sealingly forming an interface with said electrode, said insulator ring having an inner edge surface section which protrudes radially inwardly of the inner extent of said metallic coating.

9. The image intensifier tube of claim 7 wherein said means for preventing includes said insulator ring having an inner edge surface section configuration selected from the group including: a chamfer surface, a serpentine surface, a radiused surface, an crowned surface, a ribbed surface, a grooved surface, and a flanged surface.

10. The image intensifier tube of claim 9 wherein said inner edge surface section means includes an inner surface configuration which also prevents line-of-sight relation at the inner extent of interfaces defined between said insulator ring and each of said electrode and said adjacent electrode.

11. The image intensifier tube of claim 9 wherein said inner edge surface section means configuration is selected to be a chamfered configuration, and said chamfered configuration includes adjacent surface portions which cooperatively define exterior angles of less than 270 degrees.

12. An image intensifier tube which is substantially free of PC Flash comprising a tubular electrode separated from an adjacent tubular electrode by an insulator ring; and means for capturing electrons emitted from said insulator ring.

13. The image intensifier tube of claim 12 wherein said means for capturing electrons emitted from said insulator ring includes a fence member radially inwardly of and congruent with said insulator ring.

14. The image intensifier tube of claim 13 further including means for maintaining said fence member at a positive voltage level relative to said tubular electrode.

15. A method of making an electrostatically-focused image intensifier tube which is substantially free of PC Flash, said method including the step of: separating a tubular electrode of said image intensifier tube from an adjacent tubular electrode with an insulator ring having inner edge surface section means configured to substantially prevent emission of electrons from said insulator ring.

16. A method of making an electrostatically-focused image intensifier tube which is substantially free of PC Flash, said method including the steps of: separating a tubular electrode of said image intensifier tube from an adjacent tubular electrode with an interposed insulator ring having a radially inner surface configuration which may emit electrons; and providing means for capturing substantially all electrons emitted from said insulator ring before said emitted electrons can fall into a microchannel plate of said image intensifier tube.

17. A method of making an electrostatically-focused image intensifier tube which is substantially free of PC Flash, said method including the steps of:

forming a tubular field-corrector electrode for said image intensifier tube;

forming a tubular field-former electrode for said image intensifier tube;

sealingly connecting said field-corrector electrode to said field-former electrode while electrically separating said electrodes from one another by interposing an insulator ring therebetween; and configuring said insulator ring at an inner edge surface section thereof to inhibit emission of electrons from said inner edge surface section.

18. The method of claim 17 wherein said step of configuring said insulator ring inner edge surface section includes the step of forming said inner edge surface section of said insulator ring to define a shape selected from the group including: a chamfer surface, a serpentine surface, a radiused surface, an crowned surface, a ribbed surface, a grooved surface, and a flanged surface.

19. The method of claim 18 wherein said step of configuring said insulator ring inner edge surface section includes the step of selecting a chamfer surface shape for said insulator ring.

20. The method of claim 19 wherein said step of configuring said insulator ring inner edge surface section includes the step of causing said chamfer shape to include adjacent edge surface portions which cooperatively define exterior angles for said surfaces of less than 270 degrees.

21. The method of claim 17 wherein said step of configuring said inner edge surface section of said insulator ring includes the step of choosing a surface configuration which prevents line-of-sight relation between the inner extent of interfaces defined between said insulator ring and each of said electrodes.

22. An electrostatically-focused image intensifier tube which is substantially free of PC Flash, said image intensifier tube comprising: a chambered tubular body including plural conductive tubular portions stacked end-to-end and sealingly connected with one another while being electrically isolated from one another by plural interposed insulator rings; a face plate sealingly spanning and closing one end of said tubular body; and an output window member sealingly spanning and closing the opposite end of said tubular body; said tubular body, said face plate and said output window member cooperating to define a chamber which is evacuated to a high vacuum; a photocathode disposed inside of said face plate to receive photons of an image focused therethrough and to emit photoelectrons into said cavity in response to said photons; electrostatic focusing electrode means for directing said photoelectrons toward said opposite end of said tubular body in an inverted pattern replicating said image; a microchannel plate for receiving said photoelectrons in said inverted pattern and for releasing secondary emission electrons in response thereto in an intensified inverted pattern replicating said image; and a phosphorescent screen for receiving said intensified inverted pattern of electrons and for producing a visible image in response thereto; said image tube further including at least one of: means for preventing unwanted emission into said cavity of electrons which could fall into said microchannel plate and cause said PC Flash, and means for capturing electrons which are emitted into said cavity and which could fall into said microchannel plate to cause said PC Flash.

23. The image intensifier tube of claim 22 wherein said means for preventing unwanted emission of electrons into said cavity includes one of said insulator rings including an inner edge surface section defining a configuration which is substantially free of sharp-edged corners adjacent to the more negatively charged one of the electrodes interfacing with said insulator ring.

24. The image intensifier tube of claim 22 wherein said means for preventing unwanted emission into said cavity of electrons which could fall into said microchannel plate includes one of said insulator rings including an inner edge surface section defining at least one chamfer surface.

25. The image intensifier tube of claim 22 wherein said means for preventing unwanted emission into said cavity of electrons which could fall into said microchannel plate includes one of said insulator rings including an inner edge surface section defining a configuration selected from the group including: a serpentine surface, a radiused surface, an crowned surface, a ribbed surface, a grooved surface, and a flanged surface.

26. The image intensifier tube of claim 22 wherein said means for capturing electrons which are emitted into said cavity and which could fall into said microchannel plate and cause said PC Flash includes a fence member which is disposed radially inwardly of and in the path of said electrons from a point of their emission into said cavity on a path toward said microchannel plate as determined by said electrostatic focusing electrode means.

27. An electrostatically-focused image intensifier tube which is substantially free of PC Flash, said image intensifier tube comprising a tubular electrode separated from an adjacent tubular electrode by an insulator ring; said insulator ring having an inner edge surface section which defines a chamfer surface; and said chamfer surface defines with an adjacent surface portion of said insulator ring an exterior angle of less than 270 degrees.

28. The image intensifier tube of claim 27 wherein said chamfer surface and said adjacent surface define an exterior angle with one another of substantially 135 degrees.

* * * * *